United States Patent [19]

Givens, Jr.

[11] Patent Number: 4,488,149

[45] Date of Patent: Dec. 11, 1984

[54] ELECTRONIC DISPLAY HAVING SEGMENTS WHEREIN EACH SEGMENT IS CAPABLE OF SELECTIVELY ILLUMINATING TWO COLORS

[76] Inventor: William A. Givens, Jr., 4815 W. Grove, Apartment 507, Dallas, Tex. 75248

[21] Appl. No.: 238,553

[22] Filed: Feb. 26, 1981

[51] Int. Cl.[3] ..... G09G 3/14

[52] U.S. Cl. ..... 340/762; 340/702; 340/715

[58] Field of Search ..... 340/715, 762, 782, 701, 340/702, 703, 704

[56] References Cited

U.S. PATENT DOCUMENTS

| | | | |
|---|---|---|---|
| 3,480,873 | 10/1974 | Usui | 340/762 |
| 3,531,585 | 9/1970 | Strain . | |
| 3,740,570 | 6/1973 | Kaelin et al. . | |
| 3,875,473 | 4/1975 | Lebailly . | |
| 3,909,788 | 9/1975 | Kaelin et al. . | |
| 3,927,399 | 12/1975 | Fuzzell . | |
| 3,987,401 | 10/1976 | Irving | 340/782 |
| 4,297,692 | 10/1981 | Maier | 340/715 |
| 4,301,450 | 11/1981 | Smoliar | 340/715 |

*Primary Examiner*—Marshall M. Curtis
*Attorney, Agent, or Firm*—Dunlap & Codding

[57] ABSTRACT

An electronic display including a first light emitting diode emitting a first color when biased in the forward direction, a second light emitting diode emitting a second color when biased in the forward direction, and means to selectively bias one of the first and the second light emitting diodes in the forward direction so the electronic display emits one of the first and the second colors.

7 Claims, 5 Drawing Figures

ELECTRONIC DISPLAY HAVING SEGMENTS WHEREIN EACH SEGMENT IS CAPABLE OF SELECTIVELY ILLUMINATING TWO COLORS

BACKGROUND OF THE INVENTION

1. Field of the Invention

The present invention relates generally to electronic displays and, more particularly, but not by way of limitation, to an electronic display having segments which can be selectively biased to emit one of a first and a second color.

2. Brief Description of the Prior Art

U.S. Pat. No. 3,531,585, issued to Strain, disclosed a display device having an electroluminescent device with a plurality of layers of phosphorus, each being respectively capable of electroluminescence of differing colors.

U.S. Pat. No. 3,909,788, issued to Kaelin, et al., disclosed a driving circuit for light emitting diodes arranged to achieve a selectable color display. This device included a control for controlling the brightness of the biased light emitting diode to emit predetermined colors.

U.S. Pat. No. 3,740,570, issued to Kaelin, et al., disclosed light emitting diodes arranged in a matrix with a brightness control for selectively controlling the emitted color.

U.S. Pat. No. 3,875,473, issued to Lebailly, disclosed a device capable of emitting different colors.

U.S. Pat. No. 3,927,399, issued to Fuzzell, disclosed a circuit with light emitting diodes, lenses being used to obtain different colors.

BRIEF DESCRIPTION OF THE DRAWINGS

FIG. 5 is a schematic view of a modified seven segment display which is constructed in accordance with the present invention.

DESCRIPTION OF THE PREFERRED EMBODIMENTS

Figure 1:
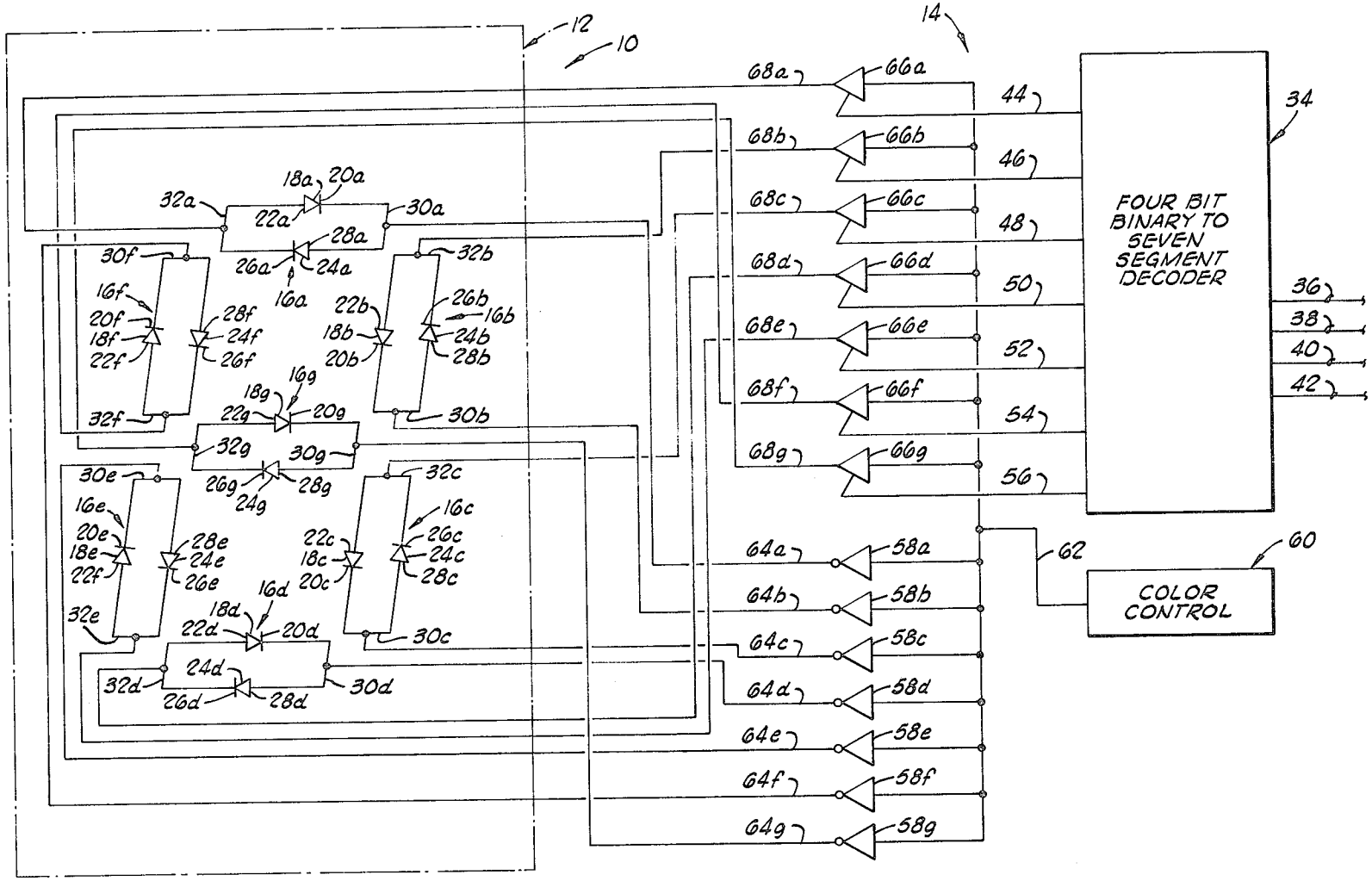
FIG. 1 is a diagrammatic, schematic view of an electronic display constructed in accordance with the present invention.

Referring to the drawings in general and to FIG. 1 in particular, shown therein and designated by the general reference numeral 10 is an electronic display which is constructed in accordance with the present invention. The electronic display 10 includes a seven segment display 12 and a driving network 14.

The seven segment display 12 includes seven segments 16, each of the seven segments 16 being identical in construction and designated respectively in FIG. 1 by the reference numerals 16*a*, 16*b*, 16*c*, 16*d*, 16*e*, 16*f*, and 16*g*. The seven sgements 16 are arranged to form the seven segment display 12 such that, by activating selected ones of the seven segments 16, the seven segment display 12 will display a predetermined indicia, such as a predetermined numeral or letter of the alphabet. The arrangement and operation of seven segment displays generally are well known in the art and a detailed description of such is not required herein.

Each segment 16 includes a first light emitting diode 18 having a cathode 20 and an anode 22, a second light emitting diode 24 having a cathode 26 and an anode 28. The first light emitting diodes are designated in FIG. 1 by the reference numerals 18*a*, 18*b*, 18*c*, 18*d*, 18*e*, 18*f*, and 18*g*, and the respective cathodes and anodes are designated in FIG. 1 by the reference numerals 20*a*, 20*b*, 20*c*, 20*d*, 20*e*, 20*f*, and 20*g*, and 22*a*, 22*b*, 22*c*, 22*d*, 22*e*, 22*f*, and 22*g*. The second light emitting diodes are designated in FIG. 1 by the reference numerals 24*a*, 24*b*, 24*c*, 24*d*, 24*e*, 24*f*, and 24*g*, and the respective cathodes and anodes are designated in FIG. 1 by the reference numerals 26*a*, 26*b*, 26*c*, 26*d*, 26*e*, 26*f*, and 26*g*, and 28*a*, 28*b*, 28*c*, 28*d*, 28*e*, 28*f*, and 28*g*.

In each segment 16, the cathode 20 of the first light emitting diode 18 is connected to the anode 28 of the second light emitting diode 24 by a signal path 30, and the anode 22 of the first light emitting diode 18 is connected to the cathode 26 of the second light emitting diode 24 by a signal path 32, the respective signal paths 30 being designated by the reference numerals 30*a*, 30*b*, 30*c*, 30*d*, 30*e*, 30*f*, and 30*g* in the drawings and the respective signal paths 32 being designated by the reference numerals 32*a*, 32*b*, 32*c*, 32*d*, 32*e*, 32*f*, and 32*g* in the drawings.

Each of the first light emitting diodes 18 is constructed to emit a first color when biased in the forward direction or, in other words, when a positive potential is applied to the anode 22 and a negative potential is applied to the cathode 20. Each of the second light emitting diodes 24 is constructed to emit a second color when biased in the forward direction or, in other words, when a positive potential is applied to the anode 28 and a negative potential is applied to the cathode 26.

The driving network 14 is connected to each of the segments 16 and the driving network 14 is constructed to selectively bias one of the first and the second light emitting diodes 18 and 24 of predetermined or selected ones of the segments 16 to cause the seven segment display 12 to display a predetermined indicia in the first or the second color. It should be noted that the driving network 14 could be constructed to rapidly and alternately bias the first and the second light emitting diodes 18 and 24 in the forward direction to cause the seven segment display 12 to display a predetermined indicia in the illusion of a third color resulting from the alternating emitting of the first and the second colors.

The driving network includes a four bit binary to seven segment decoder 34 which is constructed to receive an input binary code on the input signal paths 36, 38, 40, and 42 indicative of a predetermined indicia. In response to receiving the input binary code, the seven segment decoder 34 decodes the input binary code and provides output signals on the output signal paths 44, 46, 48, 50, 52, 54, and 56 indicative of the predetermined indicia for causing selected ones of the seven segments 16 to display the predetermined indicia indicated by the input binary code. Decoders which are constructed to receive input binary codes indicative of predetermined indicia and to provide output signals indicative of the predetermined indicia for causing a seven segment display to display the predetermined indicia are well known in the art and a detailed description of the construction and the operation of such decoders is not required herein.

The driving network 14 also includes seven inverting buffers 58*a*, 58*b*, 58*c*, 58*d*, 58*e*, 58*f*, and 58*g*, and a color control 60. The color control 60 is constructed to provide a color control signal on an output signal path 62 in either the high state (positive potential) or the low state (negative or ground potential) for biasing one of the first and the second light emitting diodes 18 and 24 in the forward direction to cause the segments 16 to emit the first or the second color, the signal path 62 being connected to the input of each of the inverting buffers 58.

Each inverting buffer 58 receives the color control signal on the signal path 62 and provides an inverted output signal on the respective output signal paths 64*a*, 64*b*, 64*c*, 64*d*, 64*e*, 64*f*, and 64*g*, or, in other words, each inverting buffer 58 provides an output signal in the high state in response to receiving the color control signal in the low state and provides an output signal in the low state in response to receiving the color control signal in the high state. Each of the inverting buffers 58 is connected to the common connection between the cathode 20 of the first light emitting diode 18 and the anode 28 of the second light emitting diode 24 of one of the segments 16, the inverting buffer 58*a* output signal path 64*a* being connected to the signal path 30*a*, the inverting buffer 58*b* output signal path 64*b* being connected to the signal path 30*b*, the inverting buffer 58*c* output signal path 64*c* being connected to the signal path 30*c*, the inverting buffer 58*d* output signal path 64*d* being connected to the signal path 30*d*, the inverting buffer 58*e* output signal path 64*e* being connected to the signal path 30*e*, the inverting buffer 58*f* output signal path 64*f* being connected to the signal path 30*f*, and the inverting buffer 58*g* output signal path 64*g* being connected to the signal path 30*g*.

The driving network 14 also includes seven tri-state non-inverting buffers 66*a*, 66*b*, 66*c*, 66*d*, 66*e*, 66*f*, and 66*g*. Each non-inverting buffer 66 receives one of the output signals provided by four bit binary to seven segment decoder 34. More particularly, the buffer 66*a* receives the output signal provided on the signal path 44, the buffer 66*b* receives the output signal provided on the signal path 46, the buffer 66*c* receives the output signal provided on the signal path 48, the buffer 66*d* receives the output signal provided on the signal path 50, the buffer 66*e* receives the output signal provided on the signal path 52, the buffer 66*f* receives the output signal provided on the signal path 54, and the buffer 66*g* receives the output signal provided on the signal path 56. The signals provided on the output signal paths 44, 46, 48, 50, 52, 54, and 56 are connected to control inputs of the buffers 66*a*, 66*b*, 66*c*, 66*d*, 66*e*, 66*f*, and 66*g*, respectively. Each buffer 66 is constructed to provide a high impedance output in response to receiving a signal in the low state at the control input of the buffer 66 regardless of the logic state of the input signal to the buffer 66, and each buffer 66 provides an output signal in the same logic state as the logic state of the input signal received by the buffer 66 when receiving a signal in the high state at the control input of the buffer 66.

Each buffer 66 receives the color control signal provided on the signal path 62 and each buffer 66 provides an output signal on a signal path 68 which is in the same logic state as the received color control signal, the signal paths 68 being designated respectively 68*a*, 68*b*, 68*c*, 68*d*, 68*e*, 68*f*, and 68*g*, in the drawings. The signal path 68 of each buffer 66 is connected to the common connector between the anode 22 of the first light emitting diode 18 and the cathode 26 of the second light emitting diode 24 of one of the segments 16, the signal paths 68 being connected to the respective signal paths 32.

The signals on the output signal paths 44, 46, 48, 50, 52, 54, and 56 determine which of the segments 16 will be emitting one of the first and second colors. If the signal on any of the output signal paths 44, 46, 48, 50, 52, 54, and 56 is in the low state, the non-inverting buffer 66 connected to that signal path will be conditioned to provide a high impedance output on the buffers 66 output signal path 68 and, in that condition or state of the buffer 66, neither the first nor the second light emitting diodes 18 or 24 can be forward biased. However, when any of the signals on the signal paths 44, 46, 48, 50, 52, 54, and 56 is in the high state, the non-inverting buffer 66 connected to such signal path operates to provide an output signal on the signal path 68 which is in the same state (high or low) as the color control signal received on the signal path 62. Thus, when the signal on one of the signal paths 44, 46, 48, 50, 52, 54, and 56 is in the high state, the color control signal functions to determine whether the first or the second light emitting diode 18 or 24 will emit color.

The color control signal is connected to the cathode 20 of the first light emitting diode 18 and to the anode 28 of the second light emitting diode 24 of each segment 16 via one of the inverting buffers 58, and thus the signal applied to the cathode 20 and the anode 28 of the first and the second light emitting diodes will be in a state (high or low) which is the opposite of the state of the applied color control signal since the inverting buffer 58 functions to invert the received color control signal. The color control signal is connected to the anode 22 of the first light emitting diode 18 and to the cathode 26 of the second light emitting diode 24 via one of the non-inverting buffers 66, and thus the signal applied to the anode 22 and the cathode 26 of the first and second light emitting diodes 18 and 24 will be in the same state (high or low) as the color control signal. Thus, the inverting buffers 58 cooperate to assure that the first and the second light emitting diodes 18 and 24 will be biased in opposite directions and the direction of such biasing is controlled by the color control signal. The foregoing description presumes that the signal connected to the control input of the non-inverting buffer 66 is in the high state.

By way of example, assume that the four bit binary input code is indicative of an indicia which requires the illumination of the segment 16*a*, then this input code will be decoded by the decoder 34 and the decoder 34 will provide an output signal on the signal path 44 in the high state, such signal being received by the non-inverting buffer 66*a*. Further, assume that it is predetermined that the segment 16*a* is to emit the first color, then the color control will provide an output color control signal on the signal path 62 in the high state. The color control signal in the high state will be received by the inverting buffer 58*a* which will provide an output signal on the signal path 64*a* in the low state and the color control signal in the high state will be received by the non-inverting buffer 66*a* which will provide an output signal on the path 68*a* in the high state. In this condition, the first light emitting diode 18*a* of the segment 16*a* will be biased in the forward direction (a signal in the high state or a positive potential being applied to the anode 22*a* and a signal in the low state or respective potential being applied to the cathode 20*a*) and the second light emitting diode 24*a* will be biased in the reverse direction with a signal in the low state or negative potential being applied to the anode 28*a* and a signal in the high state or positive potential being applied to the cathode 26*a*. When the first light emitting diode 18*a* of the segment 16*a* is biased in the forward direction, the first light emitting diode 18*a* will emit the first color.

Further, by way of example, assume that the seven segment display 12 is to be conditioned to display the numeral "4" in the first color. Then, the segments 16*b*, 16*c*, 16*f*, and 16*g* will be conditioned so that the first light emitting diodes 18*b*, 18*c*, 18*f*, and 18*g* of the segments 16*b*, 16*c*, 16*f*, and 16*g*, respectively, will be forward biased and thus emit the first color. The four bit input binary code will be "0100" which is the binary equivalent of the numeral "4", and thus a signal in the low state will be applied to the signal path 36, a signal in the high state will be applied to the signal path 38, a signal in the low state will be applied to the signal path 40 and a signal in the low state will be applied to the signal path 42. In response to receiving this particular input signal, the decoder 34 will provide the appropriate output signals to cause the segments 16*b*, 16*c*, 16*f*, and 16*g* to emit a color or, more particularly, the decoder 34 will provide an output signal on the signal path 44 in the low state, an output signal on the signal path 46 in the high state, an output signal on the signal path 48 in the high state, an output signal on the signal path 50 in the low state, an output signal on the signal path 52 in the low state, an output signal on the signal path 54 in the high state, and an output signal on the signal path 56 in the high state. In this condition, the non-inverting buffers 66*a*, 66*d*, and 66*e*, each will receive a signal in the low state at the respective control inputs, and each buffer 66*a*, 66*d*, and 66*e* will provide an output signal on the respective signal paths 68*a*, 66*d*, and 66*e* having a high impedance. In this state of the buffers 66*a*, 66*d*, and 66*e*, the first and the second light emitting diodes 18 and 24 of the segments 16*a*, 16*d*, and 16*e* cannot be forward biased regardless of the state of the color control signal on the signal path 62*a*, 62*d*, and 62*e*. The non-inverting buffers 66*b*, 66*c*, 66*f*, and 66*g* each will receive a high signal at the respective control inputs, and each buffer 66*b*, 66*c*, 66*f*, and 66*g* will provide an output signal on the respective signal paths 68*b*, 68*c*, 68*f*, and 68*g* having the same state as the input color control signal received on the signal path 62. The inverting buffers 58 each will receive the color control signal in the high state and each of the inverting buffers 58 will provide an output signal on the respective signal paths 64 in the low state. Thus, a signal in the high state (positive potential) will be applied to the anodes 22*b*, 22*c*, 22*f*, and 22*g* of the first light emitting diodes 18*b*, 18*c*, 18*f*, and 18*g* of the segments 16*b*, 16*c*, 16*f*, and 16*g*, and a signal in the low state (negative potential) will be applied to the cathodes 20*b*, 20*c*, 20*f*, and 20*g* of the first light emitting diodes 18*b*, 18*c*, 18*f*, and 18*g* of the segments 16*b*, 16*c*, 16*f*, and 16*g*, thereby biasing the first light emitting diodes 18*b*, 18*c*, 18*f*, and 18*g* of the segments 16*b*, 16*c*, 16*f*, and 16*g* in the forward direction and causing the first light emitting diodes 18 of the segments 16*b*, 16*c*, 16*f*, and 16*g* to emit the first color, the seven segment display 12 displaying the numeral "4" via the first color of light emitting by the first light emitting diodes 18*b*, 18*c*, 18*f*, and 18*g* of the segments 16*b*, 16*c*, 16*f*, and 16*g*.

If the color control signal is in the low state, then a signal in the high state will be applied to the anode 28 of the second light emitting diode 24 and a signal in the low state will be applied to the cathode 26 of the second light emitting diode 24 of those selected segments 16 where the associated non-inverting buffer 66 is receiving a signal in the high state at the control input. In this condition, the second light emitting diode 24 will be forward biased and the second light emitting diode 24 will emit the second color.

It should be noted that an additional segment could be added to the left seven segment display 12 for displaying a decimal indicia display and another segment could be added to the right of the seven segment display 12 for displaying another decimal indicia. If both additional decimal indicia segments are added, two additional inverting buffers and two additional tri-state non-inverting buffers would be added to the driving network 14. In view of the foregoing detailed description, the construction and operation of the electronic display including the two additional decimal indicating indicia will be apparent.

Also, it should be noted that in practice an electronic display would include more than one seven segment display or a display with more than seven segments, the precise number depending upon the particular application.

EMBODIMENT OF FIG. 2

Figure 2:
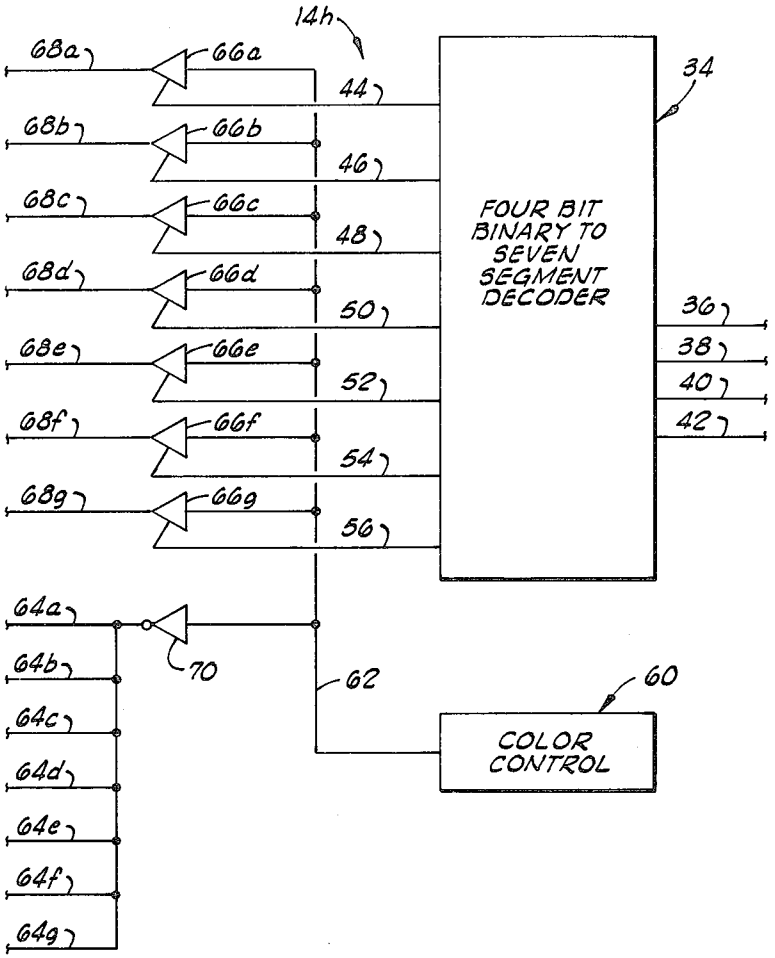
FIG. 2 is a diagrammatic, schematic view of a modified driving network which can be utilized in conjunction with the seven segment display shown in FIG. 1 to construct a modified electronic display.

Shown in FIG. 2 is a modified driving network 14*h* which can be utilized in conjunction with the seven segment display 12 shown in FIG. 1.

The driving network 14*h* is constructed exactly like the driving network 14 shown in FIG. 1, except the driving network 14*h* includes only one inverting buffer 70 in lieu of the seven inverting buffers 58*a*, 58*b*, 58*c*, 58*d*, 58*e*, 58*f*, and 58*g*. The single inverting buffer 70 receives the color control signal on the signal path 62 and provides an output signal having an inverted state with respect to the state of the received color control signal. The output signal provided by the buffer 70 is connected to and applied on the signal paths 64*a*, 64*b*, 64*c*, 64*d*, 64*e*, 64*f*, and $64_g$.

The driving network 14*h* will operate exactly like the driving network 14 shown in FIG. 1 and described in detail before, except the signal on the signal paths 64*a*, 64*b*, 64*c*, 64*d*, 64*e*, 64*f*, and 64*g* is provided by the single inverting buffer 70. With respect to the driving network 14*h*, the inverting buffer 70 must be capable of handling a current approximately equal to the sum of the currents handled by the buffers 58*a*, 58*b*, 58*c*, 58*d*, 58*e*, 58*f*, and 58*g* in the driving network 14.

EMBODIMENT OF FIG. 3

Figure 3:
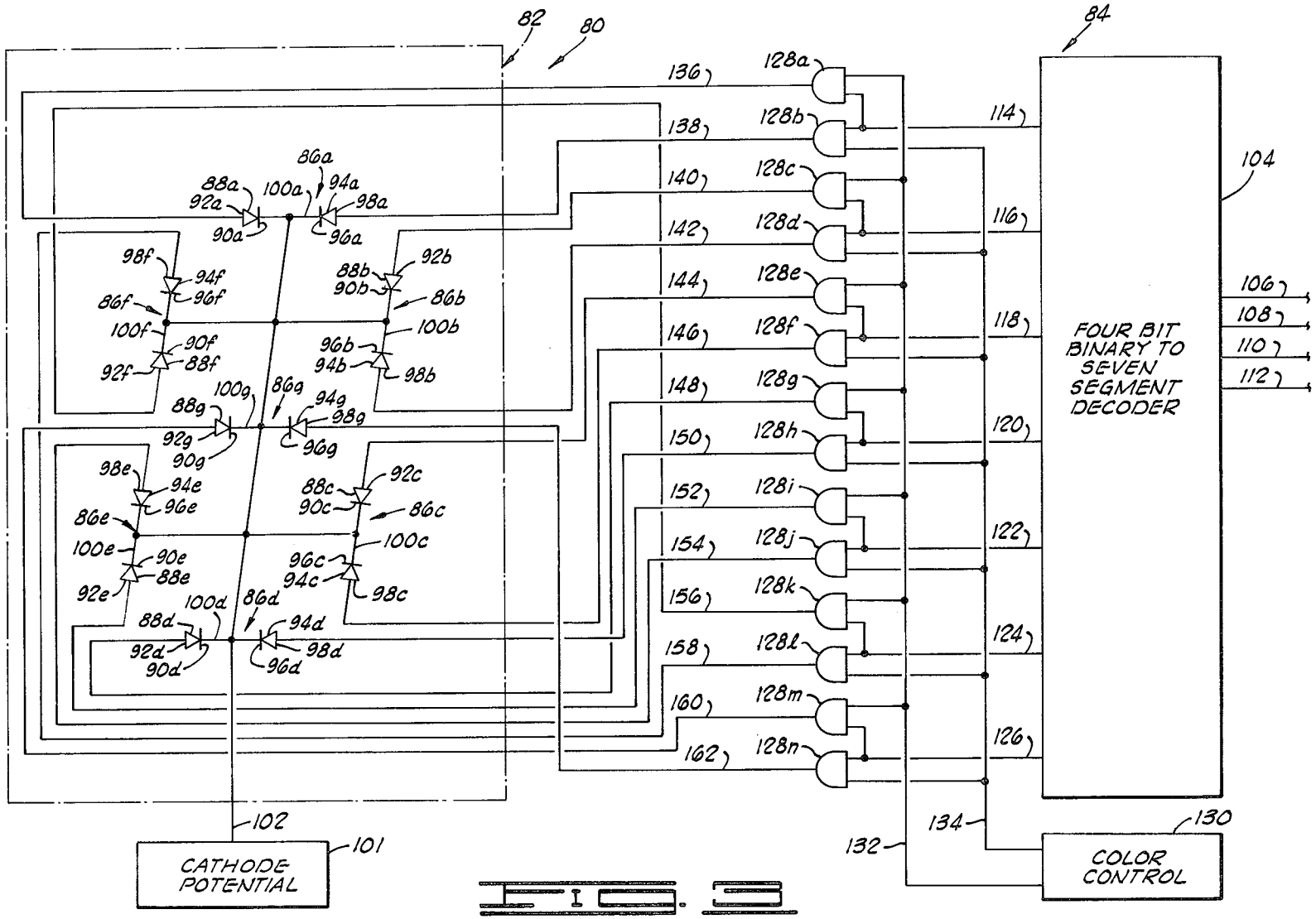
FIG. 3 is a diagrammatic, schematic view of a modified electronic display which is constructed in accordance with the present invention.
Figure 8:
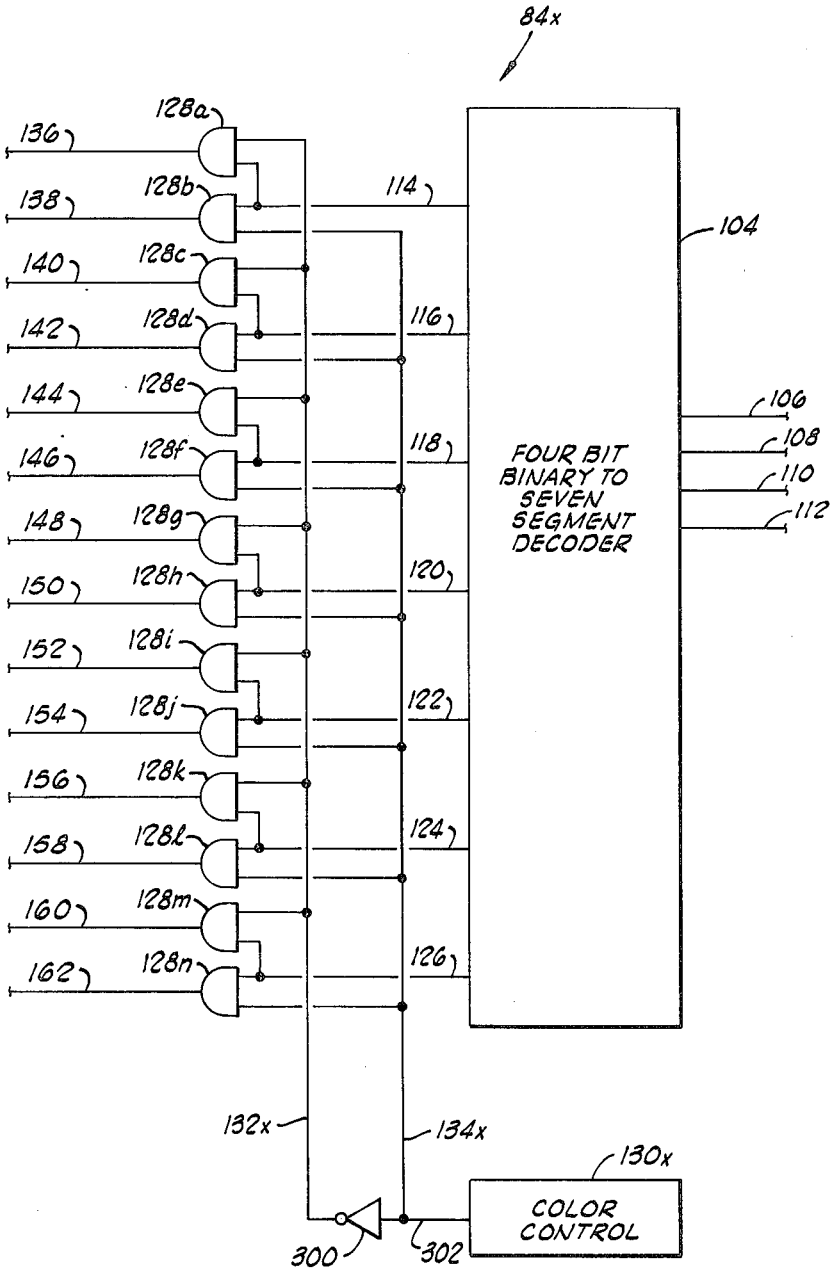

Shown in FIG. 3 is a modified electronic display 80 having a modified seven segment display 82; and a modified driving network 84, which is constructed similar to the embodiment of the present invention shown in FIG. 1.

The seven segment display 82 includes seven segments 86, each of the seven segments 86 being identical in construction and designated respectively in FIG. 3 by the reference numerals 86*a*, 86*b*, 86*c*, 86*d*, 86*e*, 86*f*, and 86*g*. The seven segments 86 are arranged to form the seven segment display 82 in a manner and for reasons like those described before with respect to the seven segment display 12 shown in FIG. 1.

Each segment 86 includes a first light emitting diode 88 having a cathode 90 and an anode 92, and a second light emitting diode 94 having a cathode 96 and an anode 98. The first light emitting diodes are designated in FIG. 3 by the reference numerals 88*a*, 88*b*, 88*c*, 88*d*, 88*e*, 88*f*, and 88*g*, and the respective cathodes and anodes are designated in FIG. 3 by the reference numerals 90*a*, 90*b*, 90*c*, 90*d*, 90*e*, 90*f*, and 90*g*, and 92*a*, 92*b*, 92*c*, 92*d*, 92*e*, 92*f*, and 92*g*. The second light emitting diodes are designated in FIG. 3 by the reference numerals 94*a*, 94*b*, 94*c*, 94*d*, 94*e*, 94*f*, and 94*g*, and the respective cathodes and anodes are designated in FIG. 3 by the reference numerals 96*a*, 96*b*, 96*c*, 96*d*, 96*e*, 96*f*, and 96*g*, and 98*a*, 98*b*, 98*c*, 98*d*, 98*e*, 98*f*, and 98*g*.

In each segment 86, the cathode 90 of the first light emitting diode 88 is connected to the cathode 96 of the second light emitting diode 94 by a signal path 100, each connection between the cathodes 90 and 96 is connected to a cathode potential 101 by a conductor 102, the respective signal paths 100 being designated by the reference numerals 100*a*, 100*b*, 100*c*, 100*d*, 100*e*, 100*f*, and 100*g* in the drawings. The cathode potential 101 is constructed to apply a negative potential to the cathodes 90 and 96 of each of the first and the second light emitting diodes 88 and 94, the negative potential being either a logic low signal or ground.

Each of the first light emitting diodes 88 is constructed to emit a first color when biased in the forward direction, and each of the second light emitting diodes 94 is constructed to emit a second color when biased in the forward direction, for reasons described before with respect to the diodes 18 and 24.

The driving network 84 is connected to each of the segments 86 and the driving network 84 is constructed to selectively bias one of the first and the second light emitting diodes 88 and 94 of predetermined or selected ones of the segments 86 to cause the seven segment display 82 to display a predetermined indicia in the first or the second color.

The driving network 84 includes a four bit binary to seven segment decoder 104 which is constructed to receive an input binary code on the input signal paths 106, 108, 110, and 112 indicative of a predetermined indicia. In response to receiving the input binary code, the seven segment decoder 104 decodes the input binary code and provides output signals on the output signal paths 114, 116, 118, 120, 122, 124, and 126 indicative of the predetermined indicia for causing selected ones of the seven segments 86 to display the predetermined indicia indicated by the input binary code.

The driving network 84 also includes fourteen AND gates 128*a*, 128*b*, 128*c*, 128*d*, 128*e*, 128*f*, 128*g*, 128*h*, 128*i*, 128*j*, 128*k*, 128*l*, 128*m*, and 128*n*, and a color control 130. The color control 130 is constructed to provide a first color control signal on an output signal path 132 in either the high state (positive potential) or the low state (negative potential) and to provide a second color control signal on an output signal path 134 in either the high state or the low state for biasing one of the first and the second light emitting diodes 88 and 94 in the forward direction to cause the segments 86 to emit the first or the second color.

Each AND gate 128*a*, 128*c*, 128*e*, 128*g*, 128*i*, 128*k*, and 128*m* receives the first color control signal on the signal path 132 and each AND gate 128*b*, 128*d*, 128*f*, 128*h*, 128*j*, 128*l*, and 128*n* receives the second color control signal on the signal path 134.

Each AND gate 128 is constructed to provide an output signal in the high state in response to receiving two input signals each in the high state. Each AND gate 128 provides an output signal in the low state in response to receiving two input signals either one or both being in the low state.

The AND gates 128*a* and 128*b* each are connected to and receive the signal provided by the decoder 104 on the signal path 114, the AND gate 128*a* providing an output signal on a signal path 136 which is connected to the anode 92*a* of the first light emitting diode 88*a* of the segment 86*a* and the AND gate 128*b* providing an output signal on a signal path 138 which is connected to the anode 98*a* of the second light emitting diode 94*a* of the segment 86*a*.

The AND gates 128*c* and 128*d* each are connected to and receive the signal provided by the decoder 104 on the signal path 116, the AND gate 128*c* providing an output signal on a signal path 140 which is connected to the anode 92*b* of the first light emitting diode 88*b* of the segment 86*b* and the AND gate 128*d* providing an output signal on a signal path 142 which is connected to the anode 98*b* of the second light emitting diode 94*b* of the segment 86*b*.

The AND gates 128*e* and 128*f* each are connected to and receive the signal provided by the decoder 104 on the signal path 118, the AND gate 128*e* providing an output signal on a signal path 144 which is connected to the anode 92*c* of the first light emitting diode 88*c* of the segment 86*c* and the AND gate 128*f* providing an output signal on a signal path 146 which is connected to the anode 98*c* of the second light emitting diode 94*c* of the segment 86*c*.

The AND gates 128*g* and 128*h* each are connected to and receive the signal provided by the decoder 104 on the signal path 120, the AND gate 128*g* providing an output signal on a signal path 148 which is connected to the anode 92*d* of the first light emitting diode 88 of the segment 86*d* and the AND gate 128*h* providing an output signal on a signal path 150 which is connected to the anode 98*d* of the second light emitting diode 94*d* of the segment 86*d*.

The AND gates 128*i* and 128*j* each are connected to and receive the signal provided by the decoder 104 on the signal path 122, the AND gate 128*i* providing an output signal on a signal path 152 which is connected to the anode 92*e* of the first light emitting diode 88*e* of the segment 86*e* and the AND gate 128*j* providing an output signal on a signal path 154 which is connected to the anode 98*e* of the second light emitting diode 94*e* of the segment 86*e*.

The AND gates 128*k* and 128*l* each are connected to and receive the signal provided by the decoder 104 on the signal path 124, the AND gate 128*k* providing an output signal on a signal path 156 which is connected to the anode 92*f* of the first light emitting diode 88*f* of the segment 86*f* and the AND gate 128*f* providing an output signal on a signal path 158 which is connected to the anode 98*f* of the second light emitting diode 94*f* of the segment 86*f*.

The AND gates 128*m* and 128*n* each are connected to and receive the signal provided by the decoder 104 on the signal path 126, the AND gate 128*m* providing an output signal on a signal path 160 which is connected to the anode 92*g* of the first light emitting diode 88*g* of the segment 86*g* and the AND gate 128*n* providing an output signal on a signal path 162 which is connected to the anode 98*g* of the second light emitting diode 94*g* of the segment 86*g*.

When the AND gate 128*a* receives a signal on the signal path 114 in the high state and a first color control signal in the high state on the signal path 132, the AND gate 128*a* provides an output signal on the signal path 136 in the high state thereby causing the first light emitting diode 88*a* to be forward biased and emit the first color. When the AND gate 128*b* receives a signal on the signal path 114 in the high state and the second color control signal in the high state on the signal path 134, the AND gate 128*b* provides an output signal on the signal path 138 in the high state thereby causing the second light emitting diode 94*a* to be forward biased and emit the second color.

When the AND gate 128*c* receives a signal on the signal path 116 in the high state and a first color control signal in the high state on the signal path 132, the AND gate 128*c* provides an output signal on the signal path 140 in the high state thereby causing the first light emitting diode 88*b* to be forward biased and emit the first color. When the AND gate 128*d* receives a signal on the signal path 116 in the high state and the second color control signal in the high state on the signal path 134, the AND gate 128*d* provides an output signal on the signal path 142 in the high state thereby causing the second light emitting diode 94*b* to be forward biased and emit the second color.

When the AND gate 128*e* receives a signal on the signal path 118 in the high state and a first color control signal in the high state on the signal path 132, the AND gate 128*e* provides an output signal on the signal path 144 in the high state thereby causing the first light emitting diode 88*c* to be forward biased and emit the first color. When the AND gate 128*f* receives a signal on the signal path 118 in the high state and the second color control signal in the high state on the signal path 134, the AND gate 128*f* provides an output signal on the signal path 146 in the high state thereby causing the second light emitting diode 94*c* to be forward biased and emit the second color.

When the AND gate 128*g* receives a signal on the signal path 120 in the high state and a first color control signal in the high state on the signal path 132, the AND gate 128*g* provides an output signal on the signal path 148 in the high state thereby causing the first light emitting diode 88*d* to be foreard biased and emit the first color. When the AND gate 128*h* receives a signal on the signal path 120 in the high state and the second color control signal in the high state on the signal path 134, the AND gate 128*h* provides an output signal on the signal path 150 in the high state thereby causing the second light emitting diode 94*d* to be forward biased and emit the second color.

When the AND gate 128*i* receives a signal on the signal path 122 in the high state and a first color control signal in the high state on the signal path 132, the AND gate 128*i* provides an output signal on the signal path 152 in the high state thereby causing the first light emitting diode 88*e* to be forward biased and emit the first color. When the AND gate 128*j* receives a signal on the signal path 122 in the high state and the second color control signal in the high state on the signal path 134, the AND gate 128*j* provides an output signal on the signal path 154 in the high state thereby causing the second light emitting diode 94*e* to be forward biased and emit the second color.

When the AND gate 128*k* receives a signal on the signal path 124 in the high state and a first color control signal in the high state on the signal path 132, the AND gate 128*k* provides an output signal on the signal path 156 in the high state thereby causing the first light emitting diode 88*f* to be forward biased and emit the first color. When the AND gate 128*l* receives a signal on the signal path 124 in the high state and the second color control signal in the high state on the signal path 134, the AND gate 128*l* provides an output signal on the signal path 158 in the high state thereby causing the second light emitting diode 94*f* to be forward biased and emit the second color.

When the AND gate 128*m* receives a signal on the signal path 126 in the high state and a first color control signal in the high state on the signal path 132, the AND gate 128*m* provides an output signal on the signal path 160 in the high state thereby causing the first light emitting diode 88*g* to be foreard biased and emit the first color. When the AND gate 128*n* receives a signal on the signal path 126 in the high state and the second color control signal in the high state on the signal path 134, the AND gate 128*n* provides an output signal on the signal path 162 in the high state thereby causing the second light emitting diode 94*g* to be forward biased and emit the second color.

The color control 130 is constructed to provide only one of the first and the second color control signals in the high state and the opposite color control signal in the low state at any one time. When the first color control signal is in the high state and the second color control signal is in the low state, only the first light emitting diodes 88 can be forward biased to emit the first color. When the second color control is in the high state and the first color control signal is in the low state, only the second light emitting diodes 94 can be forward biased to emit the second color. It should be noted that, in the alternative, the driving network 84 could be constructed to bias both the first and the second light emitting diodes 88 and 94 in the forward direction to cause the seven segment display 82 to display a predetermined indicia in a third color resulting from the simultaneous emitting of the first and the second colors.

By way of example, assume that the seven segment display 82 is to be conditioned to display the numeral "4" in the first color. Then, the segments 86*b*, 86*c*, 86*f*, and 86*g* will be conditioned so that the first light emitting diodes 88*b*, 88*c*, 88*f*, and 88*g* of the segments 86*b*, 86*c*, 86*f*, and 86*g*, respectively, will be forward biased and thus emit the first color. The four bit input binary code will be "0100" which is the binary equivalent of the numeral "4", and thus a signal in the low state will be applied to the signal path 106, a signal in the high state will be applied to the signal path 108, a signal in the low state will be applied to the signal path 110 and a signal in the low state will be applied to the signal path 112. In response to receiving this particular input signal, the decoder 104 will provide the appropriate output signals to cause the segments 86*b*, 86*c*, 86*f*, and 86*g* to emit a color or, more particularly, the decoder 104 will provide an output signal on the signal path 114 in the low state, an output signal on the signal path 116 in the high state, an output signal on the signal path 118 in the high state, an output signal on the signal path 120 in the low state, an output signal on the signal path 122 in the low state, an output signal on the signal path 124 in the high state, and an output signal on the signal path 126 in the high state. In this condition, the AND gates 128*a*, 128*b*, 128*g*, 128*h*, 128*i*, and 128*j*, each will receive a signal in the low state, and each AND gate 128*a*, 128*b*, 128*g*, 128*h*, 128*i*, and 128*j* will provide an output signal on the respective signal paths 136, 138, 148, 150, 152, and 154 in the low state. In this condition, the first and the second light emitting diodes 88 and 94 of the segments 86*a*, 86*d*, and 86*e* will not be forward biased regardless of the state of the first and second color control signals on the signal paths 132 and 134. The AND gates 128*c*, 128*d*, 128*e*, 128*f*, 128*k*, 128*l*, 128*m*, and 128*n* each will receive a high signal on the respective signal paths 116, 118, 124, and 126. The AND gates 128*c*, 128*e*, 128*k*, and 128*m* also will receive the first color control signal on the signal path 132 in the high state, and thus the AND gates 128*c*, 128*e*, 128*k*, and 128*m* will each provide an output signal in the high state on the respective signal paths 140, 144, 156, and 160 in the high state thereby forward biasing the first light emitting diodes 88*b*, 88*c*, 88*f*, and 88*g* to cause the numeral "4" to be displayed in the first color.

Two additional segments could be included with the seven segment display 12 to display decimals in a manner and for reasons described before with respect to the electronic display 10.

EMBODIMENT OF FIG. 4

Figure 4:
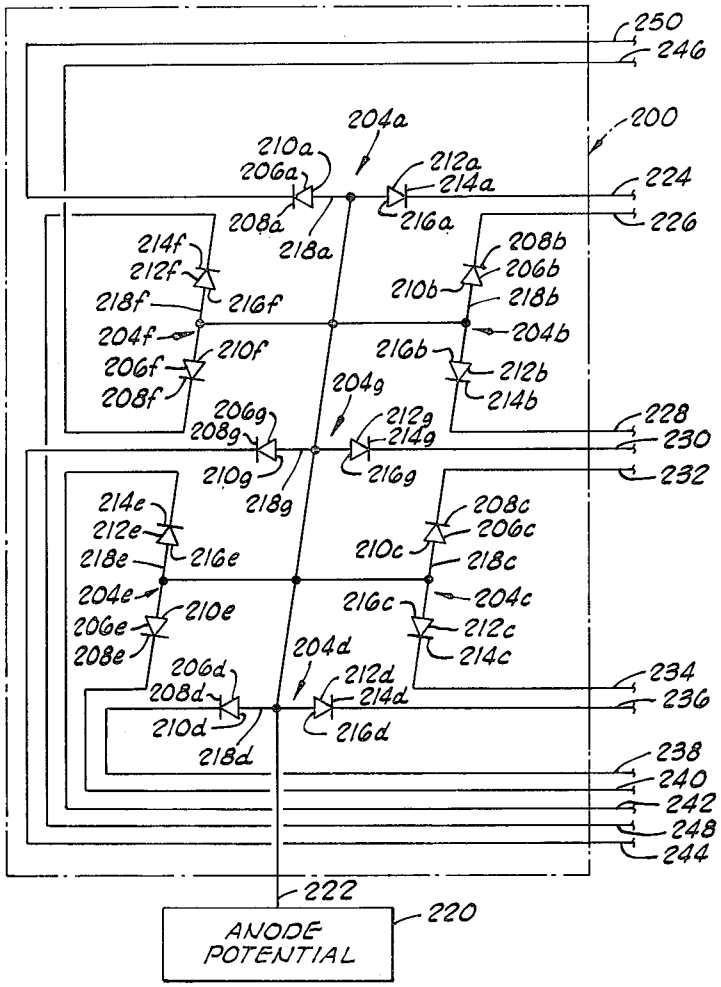
FIG. 4 is a diagrammatic, schematic view of a modified driving network which can be utilized in conjunction with the seven segment display shown in FIG. 3 to construct a modified electronic display.

Shown in FIG. 4 is a modified seven segment display 200 which is constructed and operates similar to the seven segment display 82 shown in FIG. 3.

The seven segment display 200 includes seven segments 204, each of the seven segments 204 being identical in construction and designated respectively in FIG. 4 by the reference numerals 204*a*, 204*b*, 204*c*, 204*d*, 204*e*, 204*f*, and 204*g*. The seven segments 204 are arranged to form the seven segment display 200 in a manner and for reasons like those described before with respect to the seven segment displays 12 and 82.

Each segment 204 includes a first light emitting diode 206 having a cathode 208 and an anode 210, and a second light emitting diode 212 having a cathode 214 and an anode 216. The first light emitting diodes are designated in FIG. 4 by the reference numerals 206*a*, 206*b*, 206*c*, 206*d*, 206*e*, 206*f*, and 206*g*, and the respective cathodes and anodes are designated in FIG. 4 by the reference numerals 208*a*, 208*b*, 208*c*, 208*d*, 208*e*, 208*f*, and 208*g*, and 210*a*, 210*b*, 210*c*, 210*d*, 210*e*, 210*f*, and 210*g*. The second light emitting diodes are designated in FIG. 4 by the reference numerals 212*a*, 212*b*, 212*c*, 212*d*, 212*e*, 212*f*, and 212*g*, and the respective cathodes and anodes are designated in FIG. 4 by the reference numerals 214*a*, 214*b*, 214*c*, 214*d*, 214*e*, 214*f*, and 214*g*, and 216*a*, 216*b*, 216*c*, 216*d*, 216*e*, 216*f*, and 216*g*.

In each segment 204, the anode 210 of the first light emitting diode 206 is connected to the anode 216 of the second light emitting diode 212 by a signal path 218, and each connection between the anodes 210 and 216 is connected to an anode potential 220 by a conductor 222, the respective signal paths 218 being designated by the reference numerals 218*a*, 218*b*, 218*c*, 218*d*, 218*e*, 218*f*, and 218*g* in the drawings. The anode potential 220 is constructed to apply a positive potential to the anodes 210 and 216 of each of the first and the second light emitting diodes 206 and 212, the positive potential being a logic high signal.

Each of the first light emitting diodes 206 is constructed to emit a first color when biased in the forward direction, and each of the second light emitting diodes 212 is constructed to emit a second color when biased in the forward direction, for reasons described before with respect to the diodes 18 and 24, shown in FIG. 1.

The cathodes 208 and 214 are each connected to a driving network (not shown in FIG. 4) by signal paths 224, 226, 228, 230, 232, 234, 236, 238, 240, 242, 244, 246, 248, and 250.

The driving network can be constructed exactly like the driving network 84 shown in FIG. 3 except the driving network for the seven segment display 200 must apply a negative potential or a signal having a low state to selected ones of the signal paths 224, 226, 228, 230, 232, 234, 236, 238, 240, 242, 244, 246, 248, and 250 to cause the first or the second light emitting diodes 206 or 212 to be forward biased to emit the first or the second color. This can be accomplished by modifying the decoder 104 or by interposing an inverter in each of the signal paths 136, 138, 140, 142, 144, 146, 148, 150, 152, 154, 156, 158, 160, and 162 (shown in FIG. 4) and otherwise using the identical driving network 84 shown in FIG. 4.

EMBODIMENT OF FIG. 5

Shown in FIG. 5 is a modified driving network 84*x* which is constructed exactly like the driving network 84 shown in FIG. 3, except the driving network 84*x* includes a modified color control 130*x* and an inverter 300. The color control 130*x* provides a color control signal on a signal path 302 which is connected to the signal path 134*x*, the signal on the signal path 134*x* being the second color control signal and this signal being identical to the color control signal provided by the color control 130*x*. The inverter 300 is interposed in the signal path 302 and the inverter 300 is constructed to provide an inverted output signal (a signal in the high state in response to receiving a signal in the low state on the signal path 302 and a signal in the low state in response to receiving a signal in the high state on the signal path 302). The output signal provided by the inverter 300 is connected to the signal path 132*x* and thus the inverter 300 output signal is in the first color control signal.

The driving network 84*x* will operate exactly like the driving network 84 (shown in FIG. 3). The inverter 300 assures that the first color control signal will have a state (high or low) which is opposite the state (high or low) of the second color control signal, thereby assuring that only one color will be emitted at any one time.

Changes may be made in the construction and operation of the various embodiments disclosed herein without departing from the spirit and scope of the invention as defined in the following claims.

What is claimed is:

1. An electronic display, comprising:

a segment, comprising:

a first light emitting diode having a cathode and an anode and emitting a first color when biased in the forward direction;

a second lignt emitting diode having a cathode and an anode and emitting a second color when biased in the forward direction, the cathode of the first light emitting diode being connected to the anode of the second light emitting diode and the anode of the first light emitting diode being connected to the cathode of the second light emitting diode;

means connected to the segment for selectively biasing one of the first and the second light emitting diodes in the forward direction, said means being connected to the common connection between the anode of the first light emitting diode and the cathode of the second light emitting diode and being connected to the common connection between the cathode of the first light emitting diode and the anode of the second light emitting diode, and said means selectively applying a bias to the common connection between the anode of the first light emitting diode and the cathode of the second light emitting diode and applying a negative bias to the common connection between the cathode of the first light emitting diode and the anode of the seocnd light emitting diode to bias the first light emitting diode in the forward direction, and said means selectively applying a positive bias to the common connection between the cathode of the first light emitting diode and the anode of the second light emitting diode and applying a negative bias to the common connection between the anode of the first light emitting diode and the cathode of the seocnd light emitting diode to bias the second light emitting diode in the forward direction;

a color control providing a color signal, the color control signal being connected to and applied at the common connection between the anode of the first light emitting diode and the cathode of the second light emitting diode; and an inverting buffer receiving the color control signal and providing an inverted output signal, the inverted output signal being connected to and applied at the common connection between the cathode of the first light emitting diode and the anode of the second light emitting diode, the first light emitting diode being forward biased in the high state of the color control signal and the second light emitting diode being forward biased in the low state of the color control signal; and wherein the means for selectively biasing one of the first and the second light emitting diodes is defined further to include:

a tri-state non-inverting buffer receiving the color control signal and providing an output signal connected to and received at the common connection between the anode of the first light emitting diode and the cathode of the second light emitting diode, the tri-state non-inverting buffer having a control input and providing a high impedance output signal in response to receiving a signal at the color control input in the low state and providing an output signal having the same state as the received signal in response to receiving a signal at the control input in the high state; and wherein the means for selectively biasing the first and the second light emitting diodes is defined further as applying the signal to the control input of the tri-state non-inverting buffer.

2. An electronic display, comprising:

a plurality of segments arranged for displaying predetermined indicia, each segment comprising:

a first light emitting diode having a cathode and an anode and emitting a first color when biased in the forward direction; and a second light emitting diode having a cathode and an anode and emitting a second color when biased in the forward direction, the cathode of the first light emitting diode being connected to the anode of the second light emitting diode and the anode of the first light emitting diode being connected to the cathode of the second light emitting diode; and means connected to the segment for selectively biasing one of the first and the second light emitting diodes in the forward direction, said means selectively forward biasing a selected one of the first and the second light emitting diodes of selected ones of the segments for displaying predetermined indicia, said means comprising:

a four bit binary to seven segment decoder for receiving a four bit input binary code indicating a predetermined indicia, the decoder providing output signals in a predetermined state in response to receiving the four bit binary code;

a color control providing a color control signal;

a plurality of inverting buffers, each inverting buffer receiving the color control signal and providing an inverted output signal, the inverted output signal of each inverting buffer being connected to the common connection between the cathode of the first light emitting diode and the anode of the second light emitting diode of one of the segments; and a plurality of tri-state non-inverting buffers, each non-inverting buffer receiving one of the output signals provided by the decoder at a control input and each non-inverting buffer providing an output signal having a high impedance in response to receiving a signal at the control input in the low state and each non-inverting buffer providing an output signal having the same state as a received input signal in response to receiving a signal in the high state at the control input, each non-inverting buffer receiving the color control signal and providing an output signal having the same state as the received color control signal when receiving a signal in the high state at the control input, the output signal of each non-inverting buffer being connected to and received at the common connection between the anode of the first light emitting diode and the cathode of the second light emitting diode of one of the segments.

3. An electronic display, comprising:

a plurality of segment arranged for displaying predetermined indicia, each segment comprising:

a first light emitting diode having a cathode and an anode and emitting a first color when biased in the forward direction; and a second light emitting diode having a cathode and an anode and emitting a second color when biased in the forward direction, the cathode of the first light emitting diode being connected to the cathode of the second light emitting diode;

means connected to each segment for selectively forward biasing selected ones of the first and the second light emitting diodes of selected ones of the segments by applying a logic potential to the common connection between the cathodes of the first and the second light emitting diodes, said means comprising:

a four bit binary to seven segment decoder for receiving a four bit input binary code indicating a predetermined indicia, the decoder providing output signals in a predetermined state in response to receiving the four bit input binary code;

a color control providing a first color control signal and a second color control signal;

a plurality of AND gates, each AND gate receiving the first color control signal and one of the output signals provided by the decoder and providing an output signal in the high state in response to receiving the first color control signal in the high state and receiving the decoder output signal in the high state, the output signal provided by each AND gate being connected to the anode of the first light emitting diode of one of the segments; and a plurality of AND gates, each AND gate receiving the second color control signal and one of the output signals provided by the decoder and providing an output signal in the high state in response to receiving the second color control signal in the high state and receiving the decoder output signal in the high state, the output signal provided by each AND gate being connected to the anode of the second light emitting diode of one of the segments.

4. An electronic display, comprising:

a plurality of segments arranged for displaying predetermined indicia, each segment comprising:

a first light emitting diode having a cathode and an anode and emitting a first color when biased in the forward direction; and a second light emitting diode having a cathode and an anode and emitting a second color when biased in the forward direction, the cathode of the first light emitting diode being connected to the cathode of the second light emitting diode;

means connected to each of the segments for selectively biasing one of the first and the second light emitting diodes in the forward direction, the segments being arranged for displaying predetermined indicia by forward biasing a selected one of the first and the second light emitting diodes of selected ones of the segments, said means comprising:

a four bit binary to seven segment decoder for receiving a four bit input binary code indicating a predetermined indicia, the decoder providing output signals in a predetermined state in response to receiving the four bit input binary code;

a color control providing a second color control signal;

an inverter receiving the second color control signal and providing an inverted output signal, the inverted output signal being a first color control signal;

a plurality of AND gates, each AND gate receiving the first color control signal and one of the output signals provided by the decoder and providing an output signal in the high state in response to receiving the first color control signal in the high state and receiving the decoder output signal in the high state, the output signal provided by each AND gate being connected to the anode of the first light emitting diode of one of the segments; and a plurality of AND gates, each AND gate receiving the first color control signal and one of the output signals provided by the decoder and providing an output signal in the high state in response to receiving the second color control signal in the high state and receiving the decoder output signal in the high state, the output signal provided by each AND gate being connected to the anode of the second light emitting diode of one of the segments.

5. An electronic display, comprising:

a plurality of segments arranged for displaying predetermined indicia, each segment comprising:

a first light emitting diode having a cathode and an anode and emitting a first color when biased in the forward direction; and a second light emitting diode having a cathode and an anode and emitting a second color when biased in the forward direction, the anode of the first light emitting diode being connected to the anode of the second light emitting diode and the segments being arranged for displaying predetermined indicia by forward biasing a selected one of the first and the second light emitting diodes of selected ones of the segments;

means connected to each of the elements for selectively biasing one of the first and the second light emitting diodes in the forward direction, comprising:

a four bit binary to seven segment decoder for receiving a four bit input binary code indicating a predetermined indicia, the decoder providing output signals in a predetermined state in response to receiving the four bit input binary code;

a color control providing a first color control signal and a second color control signal;

a plurality of AND gates, each AND gate receiving the first color control signal and one of the output signals provided by the decoder and providing an output signal in the low state in response to receiving one of the first color control signals and the decoder output signal in the low state, the output signal provided by each AND gate being connected to the cathode of the first light emitting diode of one of the segments; and a plurality of AND gates, and AND gate receiving the second color control signal and one of the output signals provided by the decoder and providing an output signal in the low state in response to receiving one of the second color control signals and the decoder output signal in the low state, the output signal provided by each AND gate being connected to the cathode of the second light emitting diode of one of the segments.

6. An electronic display, comprising:

a plurality of segments arranged for displaying predetermined indicia, each segment comprising:

a first light emitting diode having a cathode and an anode and emitting a first color when biased in the forward direction; and a second light emitting diode having a cathode and an anode and emitting a second color when biased in the forward direction, the anode of the first light emitting diode being connected to the anode of the second light emitting diode; and means connected to each of the segments for selectively biasing one of the first and the second light emitting diodes of selected ones of the segments by applying a logic high potential to the common connection between the anodes of the first and the second diodes, the segments being arranged for displaying a predetermined indicia by forward biasing selected ones of the first and the second light emitting diodes of selected ones of the segments, said means comprising:

a four bit binary to seven segment decoder for receiving a four bit input binary code indicating a predetermined indicia, the providing output signals in a predetermined state in response to receiving the four bit input binary code;

a color control providing a second color control signal;

an inverter receiving the second color control signal and providing an inverted output signal, the inverted output signal being a first color control signal;

a plurality of AND gates, each AND gate receiving the first color control signal and one of the output signals provided by the decoder and providing an output signal in the low state in response to receiving one of the first color control signals and the decoder output signal in the low state, the output signal provided by each AND gate being connected to the cathode of the first light emitting diode of one of the segments; and a plurality of AND gates, each AND gate receiving the second color control signal and one of the output signals provided by the decoder and providing an output signal in the low state in response to receiving one of the second color control signals and the decoder output signal in the low state, the output signal provided by each AND gate being connected to the cathode of the second light emitting diode of one of the segments.

7. An electronic display, comprising:

a plurality of segments arranged for displaying predetermined indicia, comprising:

a first light emitting diode having a cathode and an anode and emitting a first color when biased in the forward direction; and a second light emitting diode having a cathode and an anode and emitting a second color when biased in the forward direction, the segments being arranged for displaying predetermined indicia by forward biasing a selected one of the first and the second light emitting diodes of selected ones of the segments, the cathode of the first light emitting diode being connected to the anode of the second light emitting diode and the anode of the first light emitting diode being connected to the cathode of the second light emitting diode;

means connected to each of the segments for selectively biasing the first and the second light emitting diodes in the forward direction, comprising:

a four bit binary to seven segment decoder for receiving a four bit input binary code indicating a predetermined indicia, the decoder providing output signals in a predetermined state in response to receiving the four bit input binary code;

a color control providing a color control signal;

an inverting buffer receiving the color control signal and providing an inverted output signal, the inverted output signal being connected to the common connection between the cathode of the first light emitting diode and the anode of the second light emitting diode of each of the segments; and a plurality of tri-state non-inverting buffers, each non-inverting buffer receiving one of the output signals provided by the decoder at a control input and each non-inverting buffer providing an output signal having a high impedance in response to receiving a signal at the control input in the low state and each non-inverting buffer providing an output signal having the same state as a received input signal in response to receiving a signal in the high state at the control input, each non-inverting buffer receiving the color control signal and providing an output signal having the same state as the received color control signal when receiving a signal in the high state at the control input, the output signal of each non-inverting buffer being connected to and received at the common connection between the anode of the first light emitting diode and the cathode of the second light emitting diode of one of the segments.

* * * * *